United States Patent [19]

Killinger

[11] 4,421,042

[45] Dec. 20, 1983

[54] SEWING MACHINE HEAD END MODULE CONSTRUCTION

[75] Inventor: Karl H. Killinger, Dover, N.J.

[73] Assignee: The Singer Company, Stamford, Conn.

[21] Appl. No.: 507,207

[22] Filed: Jun. 22, 1983

[51] Int. Cl.[3] ..... D05B 73/02

[52] U.S. Cl. ..... 112/259

[58] Field of Search ..... 112/259, 258, 270, 237

[56] References Cited

U.S. PATENT DOCUMENTS 3,012,532 12/1961 Leslie.

3,420,200 1/1969 Johnson.

4,077,339 3/1978 Bass et al. ..... 112/258 X 4,193,361 3/1980 Johnson ..... 112/259

*Primary Examiner*—Peter P. Nerbon

*Attorney, Agent, or Firm*—Robert E. Smith; Edward L. Bell

[57] ABSTRACT

A sewing machine is disclosed in which the stitch forming instrumentalities in the head end including the needle carrying bar, the needle thread take up and tension devices, the presser mechanism and presser lifter are all carried on a module frame which can be manufactured by a single molding operation without requiring subsequent machining operations.

1 Claim, 3 Drawing Figures

SEWING MACHINE HEAD END MODULE CONSTRUCTION

DESCRIPTION

BACKGROUND OF THE INVENTION

This invention relates to lock stitch sewing machines, and more particularly, to a head end module construction providing for an extremely cost effective yet technically operative lock stitch sewing machine construction. The construction of this invention is especially useful in a sewing machine which is smaller than average in size and which is intended as a means for introducing a novice to the use of a sewing machine, or as a highly portable sewing machine by which an accomplished sewer may facilitate repairs to stitched articles or perform basic sewing tasks.

DESCRIPTION OF THE PRIOR ART

Diminutive versions of full sized sewing machines which have been known in the art heretofore, have utilized construction techniques which require machining and assembly operations comparable to that of full sized sewing machines. It is an object of this invention to provide a novel and particularly cost effective construction for all of the stitch forming instrumentalities in the head end of a sewing machine.

SUMMARY OF THE INVENTION

Not only is this object of the invention attained by provision of a modular arrangement for the sewing machine head end which may be assembled easily and efficiently apart from the sewing machine, but this object of the invention is also achieved by a novel construction and arrangement whereby machined surfaces are not required to accommodate fastening elements to support and constrain the stitch forming devices which must be carried on the module frame, so that the finished module frame may be fabricated by a single molding operation.

DESCRIPTION OF THE DRAWINGS

With the above and additional objects and advantages in view, as will hereinafter appear, this invention will now be described with reference to a preferred embodiment illustrated in the accompanying drawings in which.

DESCRIPTION OF THE PREFERRED EMBODIMENT

Figure 1:
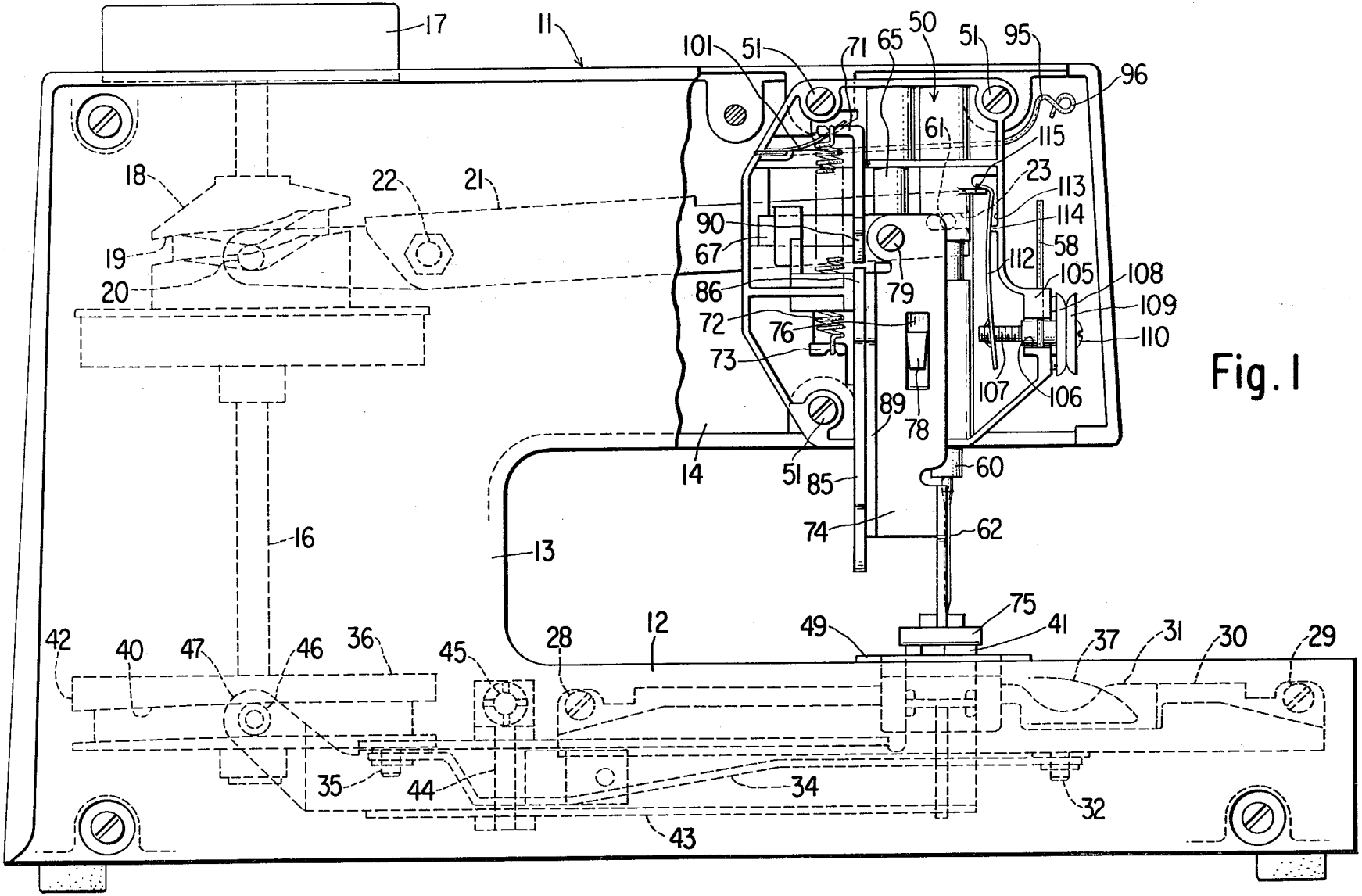
FIG. 1 is a rear elevational view of a lock stitch sewing machine with portions of the casing removed and having the modular head end construction of this invention applied thereto.

Referring to the drawings, a sewing machine casing which is indicated generally at 11 includes a work supporting bed 12, a standard 13 rising from the bed and a bracket arm 14 extending from the standard over the bed. Journalled vertically in the standard 13 is a drive shaft 16 which may have a handwheel 17 secured thereto above the frame 11; the drive shaft 16 may also be rotated by any suitable electric motor (not shown).

Fast on the drive shaft 16 is a needle reciprocating cam 18 formed with a sinuous cam groove 19 tracked by a follower 20 carried by a rocking lever 21 which is fulcrummed on a pivot pin 22 secured in the bracket arm 14. At the extremity opposite that on which the follower 20 is carried, the rocking lever 21 is formed with a bifurcation 23 for transmitting reciprocatory movement to a needle as will be described hereinbelow.

Secured in the sewing machine bed 12 by fastening screws 28 and 29 is an upwardly open channel shaped shuttle race member 30 in which a shuttle carrier 31 is slidably constrained. A pin 32 depending from the shuttle carrier 31 is embraced by one end of a connecting rod 34, the other end of which embraces a crank pin 35 carried on a rotary actuator 36 fast on the drive shaft. The shuttle carrier by this arrangement is reciprocated in the shuttle race and carries with it a shuttle 37 in which may be accommodated a bobbin (not shown) wound with under or locking thread for the formation of lock stitches.

The rotary actuator 36 is also formed with a sinuous cam groove 40 for imparting rising and falling movement to a work feed dog 41 and with a peripheral cam surface 42 for imparting feed advance and return movements to the feed dog. The feed dog is carried by a feed bar 43 which has a universal pivotal connection with the sewing machine casing 11 by way of a pin 44 which extends at right angles to and is pivotally supported on a pivot pin 45 fixed in the machine casing 11. At the extremity opposite the feed dog, the feed bar carries a follower roller 46 tracking the cam groove 40 and a follower flange 47 tracking the peripheral cam surface 42. The work feed dog 41 works upwardly through slots in a work supporting throat plate 49 secured on the sewing machine bed spanning the shuttle race member 30.

As shown in FIG. 1, all of the stitch forming instrumentalities in the bracket arm 14 which cooperate with the shuttle 37 and feed dog 41 in the formation of lock stitches are supported on an integral molded module frame 50 which is secured to the sewing machine bracket arm 14 by fastening screws 51.

Figure 2:
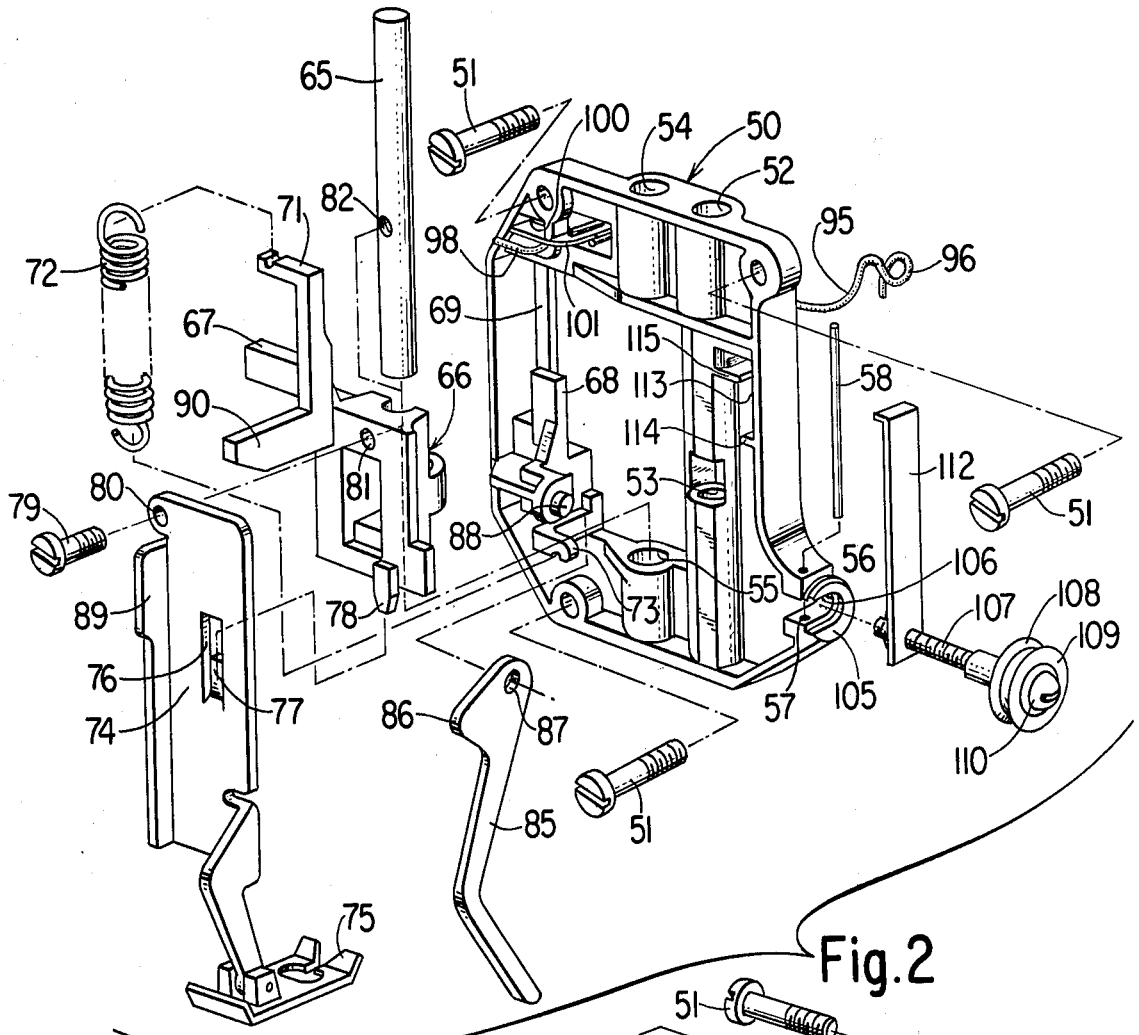
FIG. 2 is a rear perspective view of the module frame with the take up assembled thereon and the parts of the presser mechanism, presser lifter, and thread tensioning device detached and separated therefrom.
Figure 3:
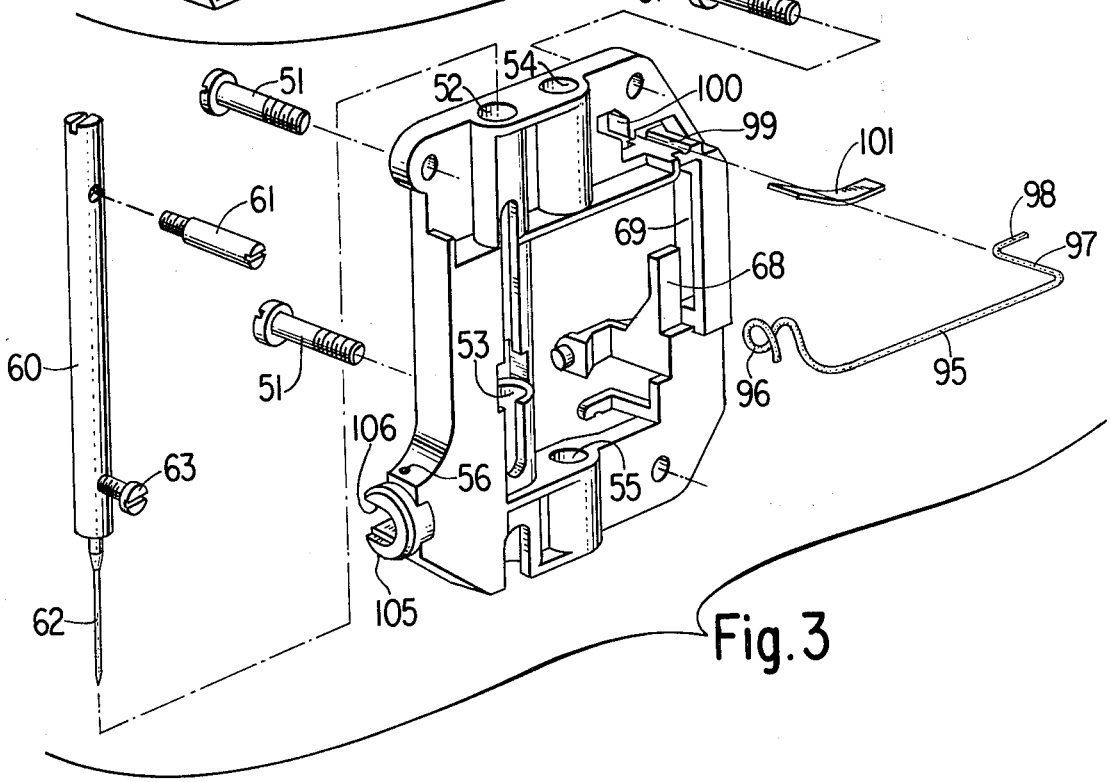
FIG. 3 is a front perspective view of the module frame with parts of the needle reciprocating mechanism and thread take up mechanism detached and separated therefrom.

The module frame 50 devoid of all or most of the elements adapted to be assembled thereon is illustrated in FIGS. 2 and 3 from which illustrations it will be appreciated that the module frame is capable of being produced in a single molding operation involving a two part die; one die part defining the characteristics of the surfaces facing the front as shown in FIG. 3, and the other die part defining the rearwardly facing surfaces as shown in FIG. 2 together with retractible die inserts for defining a first pair of spaced aligned bearing bores 52–53, a second pair of spaced aligned bearing bores 54–55, and aligned spaced holes 56–57 for accommodating a thread guiding pin 58.

A needle carrying bar 60 is endwise reciprocable in the first pair of spaced aligned bearing bores 52–53 and a crank pin 61 arranged in the space between the bearing bores is threaded transversely into the needle bar. The crank pin 61 extends into the bifurcation 23 of the rocking lever 21 which serves to reciprocate the needle bar and thus to reciprocate a sewing machine needle 62 secured by a clamp screw 63 in a needle accommodating recess in the lower extremity of the needle bar.

Endwise slidable in the second pair of aligned spaced bearing bores 54,55 is a presser bar 65 which in the space between the bearing bores 54,55 is embraced by a presser guide block 66. The guide block 66 includes a lateral projection 67 slidably engaging flat surfaces 68 and 69 on the module frame, to prevent the presser bar from turning. An upwardly offset finger 71 on the guide block engages one extremity of a coil spring 72 of which the other coil spring extremity engages an offset finger 73 formed on the module frame 50 so as to bias the presser bar in a downward direction. A sheet metal presser foot shank 74 to which a presser foot 75 is pivotally connected is formed with an aperture 76 and beneath the aperture there is a struck out portion 77 which is engageable by a protruding finger 78 formed on the presser guide block 66. A fastening screw 79 which passes through an aperture 80 in the presser foot shank 74, and an aperture 81 in the presser guide block 66 and engages a threaded hole 82 into the presser bar 65 which serves to lock together these three parts for endwise movement in unison.

A presser lifting lever 85 is formed with a cam projection 86 and a pivot aperture 87 which loosely embraces a pivot pin 88 formed on the module frame 50. As shown in FIG. 1 of the drawings, a flange 89 on the presser shank 74 is arranged closely adjacent to the presser lifting lever 85 and serves to maintain the aperture 87 in engagement with the pivot pin 88. A finger 90 formed on the presser bar guide block 66 overlies the cam projection 86 thus serving to elevate the presser foot when the presser lifting lever is raised.

As illustrated in FIGS. 2 and 3, the needle thread take up device comprises a wire thread engaging lever 95 formed on the free extremity with a pigtail thread engaging eyelet 96 and at the opposite extremity with a laterally offset axle portion 97 terminating in a short tail 98 bent at right angles to the axle portion 97. The module frame 50 is formed with a shallow upwardly open groove 99 dimensioned such that only a fraction of the axle portion of the take up lever is accommodated therein. The module frame above the groove 99 is formed with an opening 100 defining a sinuous path for a leaf spring 101 in which path the spring is constrained in stressed condition so that tension in the leaf spring not only retains the spring within the opening 100 but maintains the spring engaging and bearing against the axle portion of the take-up lever which protrudes out of the shallow groove 99. The spring 101 thus not only retains the take-up lever in place on the module member but it applies frictional resistance to turning movement of the take-up lever. The take-up lever as shown in FIG. 1, overlies the needle bar crank pin 61 so that the take-up lever is elevated when the crank pin 61 rises. However, the take-up lever is not positively driven downwardly by the needle bar crank pin but rather is driven downwardly only in response to tension developed in a thread reeved through the eyelet 96. The arrangement eliminates slack thread in the needle thread handling system and obviates the need for a conventional check spring for accomplishing that purpose.

As best shown in FIG. 2, the module frame 50 is formed with a protruding boss 105 having a rearwardly open transverse slot 106 therein. A machine screw 107 accommodated in the slot 106 carries an opposed pair of thread tensioning discs 108–109 between the screw head 110 thereof and the boss 105 on the module member 50. The machine screw is threadedly engaged in the depending extremity of a leaf spring 112 which is arranged in a recess 113 in the module frame and retained therein in stressed condition in a tortuous path defined between oppositely extending projections 114 and 115 from the module frame into the recess 113. The thread guide pin 58 serves to constrain the machine screw and with it the thread tension discs 108–109 within the slot 106 and by turning the machine screw 107 the tension exerted by the leaf spring 112 may be regulated so as to vary the tension which the opposed discs 108–109 exert on a thread placed therebetween.

The needle thread path from any source such as a conventional spool of thread supported on the sewing machine casing, extends around the thread guiding pin 58 downwardly between the tension discs 108–109, upwardly through the take-up eyelet 96, and then downwardly to the eye of the sewing machine needle 62.

The module frame 50 for all of the head end stitch forming instrumentalities may, therefore, be fabricated by a single molding operation, and does not require any machining operations to adapt it to receive fastening means for any of the instrumentalities carried thereby. Manufacture of the module and assembly of all of the instrumentalities thereon may, therefore, be accomplished apart from the machine frame and in a highly cost effective manner.

I claim:

1. In a sewing machine having a casing with a work supporting bed and a bracket arm overhanging said bed, a stitch forming loop taker and a work feeding mechanism carried within said work supporting bed, said loop taker adapted to cooperate with a reciprocating needle of the type carrying a thread which is influenced by a thread take-up device and a thread tensioning device, and said work feeding mechanism adapted to engage work fabrics in opposition to a spring biased presser foot having a presser lifter associated therewith facilitating insertion and removal of work fabrics between said work feeding mechanism and said presser device, actuating mechanism in said bed for said loop taker and work feeding mechanism, and a needle actuating mechanism extending into said bracket arm with operative connections with said actuating mechanism in said bed, the improvement which comprises a module secured to said sewing machine bracket arm and providing support for stitch forming devices including said reciprocatory needle, said needle thread take-up, said thread tension, said presser device and said presser lifter;

said module including an integral module frame of which the manufacture may be finished in a single molding operation utilizing a two part die with retractable mold inserts to define spaced aligned bearing bores in the module frame providing sliding support for the reciprocating needle and presser device, an individual leaf spring having predetermined unstressed configuration for sustaining said needle thread take-up and said thread tension on said module frame, said module frame being formed with leaf spring accommodating apertures each with a configuration deviating substantially from that of a respective one of said unstressed leaf spring configurations, a boss molded on said module frame pivotally accommodating said presser lifter, and said presser device including a surface arranged closely adjacent to said presser lifter constraining said presser lifter on said module frame boss.

* * * * *